US010357824B2

(12) United States Patent
Morinaka et al.

(10) Patent No.: US 10,357,824 B2
(45) Date of Patent: Jul. 23, 2019

(54) DENDRITIC SILVER POWDER

(71) Applicant: MITSUI MINING & SMELTING CO., LTD., Tokyo (JP)

(72) Inventors: Hiroyuki Morinaka, Hiroshima (JP); Yasunari Wakimori, Hiroshima (JP); Kentaro Ochi, Hiroshima (JP)

(73) Assignee: MITSUI MINING & SMELTING CO., LTD., Tokyo (JP)

( * ) Notice: Subject to any disclaimer, the term of this patent is extended or adjusted under 35 U.S.C. 154(b) by 0 days.

(21) Appl. No.: 15/776,295

(22) PCT Filed: Oct. 14, 2016

(86) PCT No.: PCT/JP2016/080484

§ 371 (c)(1),
(2) Date: May 15, 2018

(87) PCT Pub. No.: WO2017/094361

PCT Pub. Date: Jun. 8, 2017

(65) Prior Publication Data

US 2018/0326478 A1 Nov. 15, 2018

(30) Foreign Application Priority Data

Dec. 3, 2015 (JP) ..... 2015-236212

(51) Int. Cl.

| | |
|---|---|
| ***B22F 1/00*** | (2006.01) |
| ***H01B 1/02*** | (2006.01) |
| *H01B 5/00* | (2006.01) |
| *C25C 1/20* | (2006.01) |
| *C25C 5/02* | (2006.01) |

(52) U.S. Cl.

CPC ..... *B22F 1/0007* (2013.01); *B22F 1/00* (2013.01); *H01B 1/02* (2013.01); *B22F 2301/255* (2013.01); *B22F 2304/10* (2013.01); *C25C 1/20* (2013.01); *C25C 5/02* (2013.01); *H01B 5/00* (2013.01); *Y10T 428/12014* (2015.01)

(58) Field of Classification Search
None
See application file for complete search history.

(56) References Cited

U.S. PATENT DOCUMENTS

2017/0274453 A1* 9/2017 Okada ..... B22F 1/00

FOREIGN PATENT DOCUMENTS

| | | | |
|---|---|---|---|
| JP | H06-122905 | A | 5/1994 |
| JP | H08-209375 | A | 8/1996 |
| JP | 2001-107101 | A | 4/2001 |
| JP | 2005-146387 | A | 6/2005 |
| JP | 2006-040650 | | 2/2006 |
| JP | 2007-291499 | A | 11/2007 |
| JP | 2007-291513 | A | 11/2007 |
| JP | 2009-046696 | A | 3/2009 |
| JP | 2013-144829 | A | 7/2013 |
| JP | 2015-054982 | A | 3/2015 |

OTHER PUBLICATIONS

International Search Report, dated Jan. 10, 2017, from corresponding PCT application No. PCT/JP2016/080484.

* cited by examiner

*Primary Examiner* — Seth Dumbris
(74) *Attorney, Agent, or Firm* — Young & Thompson

(57) ABSTRACT

A new dendritic silver powder can be mixed with a synthetic resin to give electroconductive films having sufficient electroconductivity. Even when the films vary in thickness, the electroconductivity of the films can be maintained. The volume-cumulative particle diameter D50 (referred to as "D50D") determined by adding the silver powder to water containing a dispersant, applying 300-watt ultrasonic waves to the resultant mixture for 3 minutes, and examining the dispersion with a laser diffraction/scattering type particle size analyzer is 1.0-15.0 μm and that the ratio of the volume-cumulative particle diameter D50 (referred to as "D50N") determined by adding the silver powder to the water containing a dispersant and examining the mixture under the same conditions as for the D50D except that no ultrasonic waves are applied, to the D50D, D50N/D50D, is 1.0-10.0.

4 Claims, No Drawings

DENDRITIC SILVER POWDER

TECHNICAL FIELD

The present invention relates to a dendritic silver powder in which silver powder particles each having a dendritic form constitute a large part thereof.

BACKGROUND ART

Silver powder is used, for example, for electrodes and circuit formation in various electronic components, such as internal electrodes of multi-layer capacitors, conductor patterns for circuit boards, and electrodes for plasma display panel substrates. In recent years, silver powder is also used, for example, for light-shielding materials for inner layers of IC cards and magnetic cards, as well as for formation of cover-up parts of scratch cards, printing for various security purposes, and formation of fine-line circuits.

As an example of silver powder used for such electroconductive materials, Patent Literature 1 discloses a dendritic silver powder obtained according to an electroless wet process, the dendritic particulate silver powder having a D10 of 3.0 nm or less, a D50 of 12.0 nm or less, a D90 of 18.0 nm or less, and a Dmax of 44.0 nm or less, as measured according to laser diffraction/scattering particle size distribution measurement.

Patent Literature 2 discloses a dendritic silver powder having a specific surface area of 0.5-4 $m^2/g$ as measured by the BET single-point method, wherein the shape of each silver powder particle observed by an electron microscope at a magnification of 5000 or 10000 includes a rod-shaped trunk and acicular branches extending from the trunk as rod-shaped branches, or acicular branches wherein some of the branches are bent in the middle.

Various methods for producing silver powder are known, such as: an electrolytic method wherein an electrolytic solution including silver ions is electrolyzed to cause silver particles to deposit on an electrode (see Patent Literature 3); a method for obtaining a highly-dispersive spherical silver powder by a wet reduction process of producing a silver ammine complex aqueous solution with a silver nitrate solution and ammonia water, and then adding thereto an organic reducing agent, as disclosed in Patent Literature 4; and a method employing a chemical reduction method in which, for example, a reaction is caused by adding, to a silver sulfate aqueous solution, polyvinyl pyrrolidone and one of sodium phosphinate, formaldehyde, and hydroquinone as reducing agents, as disclosed in Patent Literature 5.

CITATION LIST

Patent Literature

Patent Literature 1: JP 2005-146387 A
Patent Literature 2: JP 2007-291499 A
Patent Literature 3: JP H8-209375 A
Patent Literature 4: JP 2001-107101 A
Patent Literature 5: JP H6-122905 A

SUMMARY OF INVENTION

Technical Problem

In recent years, attempts are being made to prepare electroconductive films by mixing dendritic silver powder and a synthetic resin. Conventional products, however, still have insufficient electroconductivity. Further, when a film prepared by mixing dendritic silver powder and synthetic resin is stretched and the film thickness is changed, the electroconductivity of the film tends to change significantly.

The invention thus proposes a novel dendritic silver powder that offers sufficient electroconductivity even when the dendritic silver powder is mixed with a synthetic resin and made into an electroconductive film, and with which the electroconductivity of the film can be maintained even when the film prepared by mixing the dendritic silver powder and synthetic resin is stretched and the film thickness is changed.

Solution to Problem

The present invention provides a dendritic silver powder having silver particles having a shape including a trunk and a plurality of branches that branch off perpendicularly or obliquely from the trunk and that have grown two- or three-dimensionally under observation of an electron microscope at a magnification of 3000 to 10000. The silver particles account for 50% by number or more based on all the silver particles being observed. D50D of the silver powder is 1.0-15.0 nm. D50D is defined by a volume cumulative particle diameter D50 of the silver powder, and D50 is measured by a laser diffraction/scattering particle size distribution measurement apparatus with a irradiation of ultrasonic waves wherein a dispersion containing the silver powder, a dispersant and water is subjected to irradiation of 300 watts of ultrasonic waves for 3 minutes. D50N/D50D of the silver powder is 1.0-10.0. D50N is defined by a volume cumulative particle diameter D50 of the silver powder, and D50 is measured by a laser diffraction/scattering particle size distribution measurement apparatus without the irradiation of ultrasonic waves that is carried out in measuring D50D.

Advantageous Effects of Invention

In the dendritic silver powder proposed by the invention, the aforementioned D50D and the ratio D50N/D50D are defined. Thus, it is possible to provide a novel dendritic silver powder that offers sufficient electroconductivity even when mixed with a synthetic resin and made into an electroconductive film, and with which the electroconductivity of the film can be maintained even when the film prepared by mixing the dendritic silver powder and synthetic resin is stretched and the film thickness is changed.

DESCRIPTION OF EMBODIMENTS

The invention is described below according to embodiments/examples thereof. The invention, however, is not limited to the embodiments described below.

Shape of Silver Powder Particles

The silver powder according to the present embodiment (referred to hereinafter as "present silver powder") is a silver powder including, as main component particles, silver powder particles having a shape including a trunk and a plurality of branches that branch off perpendicularly or obliquely from the trunk and that have grown two- or three-dimensionally under observation of an electron microscope at a magnification of 3000-10000 (referred to as "special dendritic silver powder particles").

Dendritic shapes encompass tree-leaf-like shapes with wide leaves stretching, and shapes in which a multitude of aciform parts extend in a radial pattern. Among various dendritic silver powder particles, the special dendritic silver powder particles each have a shape including a trunk and a plurality of branches that branch off perpendicularly or obliquely from the trunk and that have grown two- or three-dimensionally.

The present silver powder does not have to be a powder consisting only of the special dendritic silver powder particles (100% by number), and may include silver powder particles with other shapes within a range that does not inhibit the effects of the present silver powder. In this sense, it is preferable that, in the present silver powder, the special dendritic silver powder particles account for 50% by number or more, more preferably 60% by number or more, more preferably 70% by number or more, more preferably 80% by number or more, and even more preferably 90% by number or more (including 100% by number), of all the silver powder particles being observed.

D50

The central particle diameter (D50) of the present silver powder, i.e., the volume cumulative particle diameter D50D is preferably 1.0-15.0 μm. D50D is defined by a volume cumulative particle diameter D50 measured by a laser diffraction/scattering particle size distribution measurement apparatus with a pretreatment wherein a dispersion containing the silver powder, a dispersant and water is subjected to irradiation of 300 watts of ultrasonic waves for 3 minutes.

In cases where the D50D is 1.0-15.0 μm, even when a film prepared by mixing the present silver powder and a synthetic resin is stretched and the thickness of the film changes, the network among electroconductive particles in the paste is retained, and electroconductive performance can be maintained.

From this viewpoint, the D50D of the present silver powder is preferably 1.0-15.0 μm, more preferably 2.0 μm or greater and 12.0 μm or less, and even more preferably 3.0 μm or greater and 11.0 μm or less.

It should be noted that, in order to adjust the D50D of the present silver powder, for example, in order to reduce the D50D, it is preferable, for example, to shorten the electrolysis time, that is, to scrape off the silver powder that has deposited on the electrode plate in a short time. The method, however, is not limited thereto.

D50N/D50D

It is preferable that the following D50N/D50D of the present silver powder is 1.0-10.0.

More specifically, D50D is defined by a volume cumulative particle diameter D50 of the silver powder measured by a laser diffraction/scattering particle size distribution measurement apparatus with a pretreatment wherein a dispersion containing the silver powder and water is subjected to irradiation of 300 watts of ultrasonic waves for 3 minutes. The D50N is defined by a volume cumulative particle diameter D50 of the silver powder measured by a laser diffraction/scattering particle size distribution measurement apparatus without the irradiation of ultrasonic waves, that is carried out in measuring D50D, to a dispersion containing the silver powder, a dispersant and water. The ratio (D50N/D50D) of the silver powder is preferably 1.0-10.0.

In cases where the D50N/D50D of the present silver powder is 1.0-10.0, when the present silver powder is mixed with a synthetic resin, the present silver powder disperses uniformly in the synthetic resin, thus allowing electroconductivity to be maintained sufficiently.

From this viewpoint, the D50N/D50D of the present silver powder is preferably 1.0-10.0, more preferably 1.2 or greater, more preferably 1.5 or greater and 9.0 or less, and even more preferably 2.0 or greater and 8.0 or less.

In order to adjust the D50N/D50D of the present silver powder within the aforementioned range, it is preferable, for example, to dry the silver powder collected by electrolysis according to the later-described electrolysis method, while at least controlling the temperature to 40° C. or lower. Also, the D50N/D50D can be adjusted by sizing the particles after drying. The methods, however, are not limited thereto.

Specific Surface Area

The specific surface area of the present silver powder as measured by the BET single-point method is preferably 0.2-5.0 $m^2/g$.

It is preferable that the specific surface area of the present silver powder is 0.2 $m^2/g$ or greater, because the branches of the dendrite have developed sufficiently, and thus a network among particles is formed and electroconductivity can be ensured sufficiently. On the other hand, it is preferable that the specific surface area is 5.0 $m^2/g$ or less, because the branches of the dendrite do not become too thin and the particles can be dispersed without breaking the branches of the dendrite, for example, when made into a paste, and electroconductivity can be ensured sufficiently.

From this viewpoint, the specific surface area of the present silver powder is preferably 0.2-5.0 $m^2/g$, more preferably 0.3 $m^2/g$ or greater and 4.0 $m^2/g$ or less, and even more preferably 0.4 $m^2/g$ or greater and 3.0 $m^2/g$ or less.

Crystallite Diameter

The crystallite diameter of the present silver powder is preferably 500 Å-3000 Å.

It is preferable that the crystallite diameter of the present silver powder is 500 Å or greater, because the branches of the dendrite do not become too thin and the particles can be dispersed without breaking the branches of the dendrite, for example, when made into a paste, and electroconductivity can be ensured sufficiently. On the other hand, it is preferable that the crystallite diameter is 3000 Å or less, because the silver powder particles do not become too coarse, and a film with a desired thickness can be prepared.

From this viewpoint, the crystallite diameter of the present silver powder is preferably 500-3000 Å, more preferably 600 Å or greater and 2500 Å or less, and even more preferably 700 Å or greater and 2000 Å or less.

In order to adjust the crystallite diameter of the present silver powder within the aforementioned range, it is preferable, for example, to adjust the silver concentration in the later-described electrolysis method from 5 g/L to 50 g/L inclusive, as described further below. The method, however, is not limited thereto.

Usage

The main component particles of the present silver powder are special dendritic silver powder particles, and the anisotropy in shape thereof offers excellent electroconductivity. Thus, the present silver powder can be used also as electroconductive fillers for general electroconductive pastes, and is particularly suitable for preparing electroconductive films by being mixed with synthetic resin.

Production Method

For example, the present silver powder can be produced as described below. The method, however, is not limited to the following production method.

The present embodiment describes a production method for obtaining a silver powder by collecting a silver powder by electrolyzing, as an electrolytic solution, a silver salt aqueous solution including a weak acid, and drying the collected silver powder while at least controlling the temperature to 40° C. or less.

Note that, "electrolysis" as referred to in the invention encompasses both electrolytic collection using a DSE electrode and electrolytic refinement using a silver electrode.

Further, "weak acid" as referred to in the invention refers to an acid having lower dissolubility of silver than nitric acid and including an anion with a higher complexation capability with silver ions than nitrate ions, and may either be an organic acid or an inorganic acid.

Electrolysis

When a silver electrolytic solution of nitric acid is used as an electrolytic solution, it is usually not possible to obtain fine silver particles. However, by adding, to nitric acid, an acid including an anion capable of forming a complex with silver ions and having a strength that does not dissolve the deposited silver particles, it is possible to significantly reduce the diameter of silver particles, compared, for example, to cases where only nitric acid is used.

Examples of organic acids that may be added to the electrolytic solution include: aliphatic monocarboxylic acids, such as formic acid, acetic acid, propionic acid, butyric acid, valeric acid, and mercaptoacetic acid; aromatic monocarboxylic acids, such as benzoic acid; oxymonocarboxylic acids, such as glycolic acid, lactic acid, and salicylic acid; aliphatic dicarboxylic acids, such as succinic acid, oxalic acid, malonic acid, maleic acid, and fumaric acid; aromatic dicarboxylic acids, such as phthalic acid, isophthalic acid, and terephthalic acid; oxydicarboxylic acids, such as malic acid and tartaric acid; tricarboxylic acids, aromatic tricarboxylic acids, and oxytricarboxylic acids such as citric acid and isocitric acid; oxypolycarboxylic acids, such as ethylenediamine tetraacetic acid (EDTA), and aromatic polycarboxylic acids; and compounds including a carboxyl group, such as oxocarboxylic acid, amino acid, and ascorbic acid.

Preferred among the above are carboxylic acids including two or more carboxyl groups, more preferably oxycarboxylic acids including two or more carboxyl groups, such as malic acid, citric acid, and tartaric acid; and particularly preferred among the above are oxycarboxylic acids including three or more carboxyl groups, or oxycarboxylic acids including two or more carboxyl groups and two or more hydroxy groups, such as citric acid and tartaric acid.

Note that two or more types of the aforementioned acids may be added in combination to the electrolytic solution.

On the other hand, examples of inorganic acids that may be added to the electrolytic solution include boric acid, carbonic acid, sulfurous acid, and phosphoric acid. Two or more types of these acids may be added in combination to the electrolytic solution.

By adding a weak acid, such as the above, to the electrolytic solution, it is possible to reduce the particle size of silver powder particles obtained by electrolysis. The reason to this can be surmised that the growth of silver particles is inhibited because the weak acid complexes the silver ions or because the OH— in a carboxyl group or a hydroxy group adsorbs to the silver ions.

It is suitable to adjust the amount of weak acid added to be 0.01-100 g/L of the electrolytic solution, and further suitable to adjust the amount to preferably 0.05-50 g/L, even more preferably 0.1-20 g/L. If the amount is less than 0.01 g/L, formation of fine particles is difficult, because even if a carboxylic acid having two or more carboxyl groups is used, it may be difficult to obtain a sufficient chelating effect or adsorption effect. On the other hand, if the amount is greater than 100 g/L, it is uneconomical even when a carboxylic acid including two or more carboxyl groups is used.

There is no particular limitation to the silver salt aqueous solution, so long as it is a solution in which silver ions are dissolved, and for example, a silver nitrate solution can be used.

In order to increase the ionic conductance of the silver salt aqueous solution, it is preferable to add a supporting electrolyte, particularly a salt irrelevant to the reaction with the electrolytic solution such as a nitrate.

It is preferable to adjust the pH of the electrolytic solution preferably to 0-7, more preferably 1 or greater and 6 or less, and even more preferably 2 or greater and 5 or less. If the pH is below 0, the complexation capability is reduced. On the other hand, if the pH is above 7, silver is prone to precipitate as silver oxide.

It is preferable to adjust the concentration of silver in the electrolytic solution to 0.1-50 g/L, more preferably 0.5 g/L or greater and 30 g/L or less, more preferably 1.0 g/L or greater and 20 g/L or less. If the silver concentration is less than 0.1 g/L, the deposition rate of silver becomes slow, making it difficult to obtain silver powder efficiently. If the silver concentration is greater than 50 g/L, powder deposition becomes difficult.

The molar ratio of the weak acid to $Ag^+$ in the electrolytic solution is preferably 0.01-10, even more preferably 0.05-5. If the molar ratio is less than 0.01, adsorption and complexation become insufficient, making the silver particles coarse. A molar ratio higher than 10 is uneconomical.

As for electrolysis conditions, the current density is preferably 10-2000 $A/m^2$, more preferably 30-1500 $A/m^2$, even more preferably 50-1000 $A/m^2$. If the current density is lower than 10 $A/m^2$, the deposition rate of silver becomes slow, thus making the particles coarse or causing silver to be plated on the electrode. If the current density is higher than 2000 $A/m^2$, the solution temperature rises, and the shape of silver powder becomes unstable. Also, running costs increase, making it uneconomical.

The temperature of the electrolytic solution is preferably 80° C. or lower, more preferably 60° C. or lower, and even more preferably 40° C. or lower. The particles tend to get dissolved when the temperature is higher than 80° C.

Silver powder can be obtained by scraping off the silver powder deposited on the electrode plate at predetermined time intervals, and filtering, washing, and drying the silver powder scraped off from the electrode plate. At this time, the methods for filtering, washing, and drying are not particularly limited, and any general method can be employed.

Further, a rotary drum can be used, and silver powder deposited on the surface of the rotary drum can be scraped off continuously with a scraper.

The shape of the silver powder particles can be controlled, for example, by the amount of weak acid added and the electrolysis conditions. For example, increasing the amount of weak acid added tends to make the shape more spherical rather than dendritic, whereas increasing the silver concentration or reducing the current density or raising the temperature of the electrolytic solution tends to make the shape more dendritic rather than spherical.

Further, by adding a water-soluble organic polymer to the electrolytic solution and performing electrolysis as above, the dendritic silver powder can be made even finer.

Examples of water-soluble organic polymers include gelatin, polyvinyl alcohol, water-soluble starch, glue, and water-soluble carboxylates; among the above, gelatin is preferred.

It is preferable to add the water-soluble organic polymer to the electrolytic solution so that the amount is 0.05-5 g/L. If the amount is less than 0.05 g/L, a sufficient effect cannot be achieved, and if the amount is greater than 5 g/L, the particle shape becomes unstable, which is not preferable.

Washing with Water

Preferably, the silver powder collected by electrolysis as described above is washed with water to sufficiently rinse away the remaining electrolytic solution, and is further washed with alcohol to sufficiently substitute water with alcohol.

Drying

Preferably, the silver powder washed with alcohol as described above is aired and dried by at least adjusting the temperature of the drying atmosphere to 40° C. or lower.

The temperature of the drying atmosphere is preferably adjusted to 40° C. or lower, more preferably to 30° C. or lower, and it is preferable to perform drying at room temperature.

Examples of drying methods include shelf drying, vacuum drying, and freeze drying; among the above, a fan-equipped shelf drier, i.e., a forced convection shelf drier, is especially preferred.

Sizing

After drying, the particles may be sized if necessary.

For the sizing method, it is possible to employ centrifugal classification, a method of allowing particles to pass through a mesh with predetermined dimensions, such as a vibrating sieve or a flat screen, or a method of separation by air flow.

Note that, by sizing the dried product obtained by drying as described above, deagglomeration can be expected.

Surface Treatment

The silver powder obtained as described above can be subjected to organic surface treatment. By subjecting silver particles to organic surface treatment, agglomeration can be suppressed. By selecting the organic surface treatment agent appropriately, it is also possible to control affinity with other materials.

Note that surface treatment may be rendered to the dried product, or may be rendered to silver powder before being dried.

In organic surface treatment, a film made, for example, of a saturated fatty acid, an unsaturated fatty acid, a nitrogen-containing organic compound, a sulfur-containing organic compound, or a silane coupling agent may be formed on the surface of the silver particles. Among the aforementioned organic compounds, it is preferable to use a nitrogen-containing organic compound. Any known method, such as a dry method or a wet method, may be employed for the film formation method.

Explanation of Words/Expressions

In the present Description, the expression "X-Y" (where X and Y are arbitrary numbers) means "from X to Y inclusive" unless specifically stated otherwise, and also encompasses the meaning "preferably greater than X" or "preferably less than Y".

Further, the expression "X or greater" (where X is an arbitrary number) encompasses the meaning "preferably greater than X" unless specifically stated otherwise, and the expression "Y or less" (where Y is an arbitrary number) encompasses the meaning "preferably less than Y" unless specifically stated otherwise.

EXAMPLES

Examples of the invention are described below. The invention, however, is not to be limited to the following Examples.

Observation of Particle Shape

For each of the silver powders (samples) obtained according to the Examples and Comparative Examples, the respective shapes of fifty random particles were observed with a scanning electron microscope at a magnification of 5000, and the form of silver powder particles accounting for 50% by number or more of all the silver powder particles is shown in Table 1.

Note that, in order to prevent the particles from overlapping one another during observation of the particle shapes, observation was performed by attaching a small amount of silver powder (sample) onto a carbon tape.

At this time, whether or not the shape was dendritic was determined by whether or not the particle had a shape including a trunk and a plurality of branches that branch off perpendicularly or obliquely from the trunk and that have grown two- or three-dimensionally.

Particle Size Measurement

A small amount, more specifically, 0.2 g of the silver powder (sample) obtained according to an Example or a Comparative Example was placed in a beaker, and 0.07 g of Triton X-100 (product of Kanto Chemical Co., Inc.) was added to and blended with the powder. Then, the powder was added to 40 mL of dispersant-containing water (dispersant: 0.3% SN-PW-43 solution (product of San Nopco)). This was then subjected to a dispersion treatment by applying 300 watts of ultrasonic waves for 3 minutes using an ultrasonic disperser US-300AT (product of Nihonseiki Kaisha Ltd.), to prepare a measurement sample. The volume cumulative particle diameter D50D of the measurement sample was measured using a laser diffraction/scattering particle size distribution measurement apparatus MT3300II (product of Nikkiso Co., Ltd.). In the measurement, the inside of the sample circulator and the flow path was washed with the dispersant-containing water (dispersant: 0.3% SN-PW-43 solution (product of San Nopco)); then, auto-zero calibration was performed while circulating the dispersant-containing water; thereafter, a measurement sample was added to a 200 mL cell in the circulator until the display showed that the concentration was within a measurable range; and then measurement was started after verifying that the concentration was stable within the measurable range.

On the other hand, the same silver powder was used to prepare a measurement sample in a similar manner as above except that no ultrasonic waves were applied, and the volume cumulative particle diameter D50N was measured according to the same conditions as above.

Measurement of Specific Surface Area

The specific surface area was measured according to the BET single-point method with a Monosorb (product of Yuasa Ionics).

Crystallite Diameter

The crystallite diameter was measured according to the Scherrer method (crystallite diameter measurement method by X-ray diffraction) using an Ultima IV X-ray diffractometer (product of Rigaku Co., Ltd.).

Evaluation of Sheet Resistance 42.3 g of the silver powder (sample) obtained according to an Example or a Comparative Example, 99 g of a silicone resin (MRX-2269; product of Asahi Kagaku Kogyo Co., Ltd.) as a binder, and 1 g of an acrylic thickener (TT-615; product of the Dow Chemical Company) as a thickener were mixed, to prepare a paste.

Then, the paste was applied onto a silicone rubber sheet with a bar coater such that the width was 200 mm and the gap was 50 μm. The paste was then dried in an atmospheric hot air drying oven at 90° C. for 60 minutes, to obtain a 40-μm-thick coating film.

The sheet resistance value of the obtained coating film was measured by the four-point probe method using a resistivity meter (MCP-T600; product of Mitsubishi Chemical).

Note that, as for the silver powders obtained according to Examples 1 to 4, it was possible to measure a resistance value because the powder particles contacted one another sufficiently. As for the silver powder obtained according to Comparative Examples 1 and 2, the resistance value could not be measured as it was too high and exceeded the range (indicated as "Unmeasurable" in the Table).

Evaluation of Rate of Change in Electroconductivity upon Change in Film Thickness 42.3 g of the silver powder (sample) obtained according to an Example or a Comparative Example, 99 g of a silicone resin (MRX-2269; product of Asahi Kagaku Kogyo Co., Ltd.) as a binder, and 1 g of an acrylic thickener (TT-615; product of the Dow Chemical Company) as a thickener were mixed, to prepare a paste.

Then, the paste was applied onto a silicone rubber sheet with a bar coater such that the width was 200 mm and the gap was 50 μm. The paste was then dried in an atmospheric hot air drying oven at 90° C. for 60 minutes, to obtain a 40-μm-thick coating film. The obtained coating film was cut into a 2-cm-wide, 15-cm-long strip, to obtain an evaluation film.

Then, one side of the film was fixed, and the other side was pulled to stretch the film from 15 cm to 19.5 cm and fixed in that state, and the sheet resistance value of the film for when the film prepared by mixing the dendritic silver powder and synthetic resin was stretched and the thickness of the film was changed was measured by the four-point probe method using a resistivity meter (MCP-T600; product of Mitsubishi Chemical).

Example 1

A DSE electrode was used for the anode, and a drum made of stainless steel (SUS 316) was used for the cathode, and the distance between the electrodes was set to 5 cm. As the electrolytic solution, a silver nitrate solution was electrolyzed while being circulated at 300 mL/min. At this time, the liquid temperature of the electrolytic solution was 25° C., the silver concentration was 20 g/L, the nitric acid concentration was 10 g/L, the citric acid concentration was 0.5 g/L, the amount of electrolytic solution was 30 L, the pH was 2.0, and the current density was adjusted to 750 A/m$^2$, and electrolysis was performed for 60 minutes.

Silver deposited on the surface of the cathode was continuously scraped off with a scraper to collect silver powder. The collected silver powder was kept in pure water until the end of electrolysis.

After electrolysis, the powder was washed, surface treated, and filtered using a nutsche filter. First, the powder was washed with 5 L of pure water, then surface treated with 2.0 g of benzotriazole, and was then washed again with alcohol.

Then, the silver powder was transferred to a stainless-steel tray, and, using a fan-equipped shelf drier, was dried by being kept at room temperature for 15 hours in air atmosphere. After drying, the powder was sized using a sieve with 75-μm openings, and particles that passed through the sieve were collected, to obtain a silver powder (sample).

Example 2

A silver powder (sample) was obtained in the same manner as Example 1, except that the silver concentration 20 g/L and the citric acid concentration 0.5 g/L were changed to a silver concentration of 10 g/L and a citric acid concentration of 0.1 g/L.

Example 3

A silver powder (sample) was obtained in the same manner as Example 1, except that the silver concentration 20 g/L, the nitric acid concentration 10 g/L, the citric acid concentration 0.5 g/L, the pH 2.0, and the current density 750 A/m$^2$ were changed to a silver concentration of 30 g/L, a nitric acid concentration of 5 g/L, a pH of 2.5, and a current density of 1000 A/m$^2$.

Example 4

A silver powder (sample) was obtained in the same manner as Example 1, except that the silver concentration 20 g/L, the citric acid concentration 0.5 g/L, and the current density 750 A/m$^2$ were changed to a silver concentration of 30 g/L and a current density of 1500 A/m$^2$.

Comparative Example 1

To 0.8 L of pure water was dissolved 12.6 g of silver nitrate, and 24 mL of 25% ammonia water and 40 g of ammonium sulfate were further added, to prepare a silver ammine complex salt aqueous solution (silver concentration: 10 g/L; molar ratio $NH_3/Ag^+$:12; 20° C.; pH 9.4).

Using DSE electrode plates for both the anode and cathode, this silver ammine complex salt aqueous solution, as an electrolytic solution, was electrolyzed at a current density of 200 A/m$^2$ at a solution temperature of 20° C., and electrolysis was performed for 1 hour while scraping off the electrodeposited silver powder particles from the electrode plate with a scraper at suitable intervals.

Then, a slurry including the scraped-off silver powder particles was filtered with a nutsche filter, and the particles were washed with pure water and further with alcohol, and were dried at 70° C. for 12 hours in an air atmosphere, to obtain a silver powder (sample).

Comparative Example 2

A DSE electrode was used for the anode, and a plate made of stainless steel (SUS 316) was used for the cathode, and the distance between the electrodes was set to 5 cm. A silver nitrate solution was used as the electrolytic solution. The liquid temperature of the electrolytic solution was 25° C., the silver concentration was 20 g/L, the nitric acid concentration was 10 g/L, the citric acid concentration was 0.5 g/L, the amount of electrolytic solution was 3.0 L, the pH was 2.0, and the current density was adjusted to 750 A/m$^2$, and electrolysis was performed for 60 minutes, while scraping off the silver powder particles electrodeposited on the surface of the cathode with a scraper at suitable intervals.

After electrolysis, the powder was washed, surface treated, and filtered using a nutsche filter. First, the powder was washed with 5 L of pure water, then surface treated with 2.0 g of benzotriazole, and was then washed again with alcohol. Then, using a fan-equipped shelf drier, the silver powder was dried at 60° C. for 8 hours in air atmosphere, to obtain a silver powder (sample).

TABLE 1

| | | Example 1 | Example 2 | Example 3 | Example 4 | Comparative Example 1 | Comparative Example 2 |
|---|---|---|---|---|---|---|---|
| D50D (μm) | With ultrasonic wave dispersion | 11.0 | 3.0 | 13.9 | 8.4 | 3.2 | 8.8 |
| D50N (μm) | Without ultrasonic wave dispersion | 22.0 | 24.4 | 34.6 | 52.2 | 59.0 | 213.9 |
| D50N/D50D | | 2.0 | 8.1 | 2.5 | 6.2 | 18.4 | 24.3 |
| SSA ($m^2/g$) | | 0.52 | 0.95 | 1.31 | 1.60 | 3.42 | 3.47 |
| Sheet resistance (Ω · cm); Amount of filler filled: 70% | | 8.9E−04 | 2.4E−03 | 1.0E−03 | 3.8E−03 | Unmeasurable (high resistance) | Unmeasurable (high resistance) |
| Sheet resistance after change in film thickness (Ω · cm); Amount of filler filled: 70% | | 9.8E−04 | 3.2E−03 | 1.5E−03 | 4.2E−03 | Unmeasurable (high resistance) | Unmeasurable (high resistance) |
| Crystallite diameter (Å) | | 1758 | 1067 | 887 | 780 | 366 | 750 |
| Shape | | Dendritic | Dendritic | Dendritic | Dendritic | Dendritic | Dendritic |

Consideration

When observed with an electron microscope at a magnification of 5000, all of the silver powders (samples) obtained according to Examples 1 to 4 and Comparative Examples 1 and 2 were dendritic silver powders wherein silver powder particles, each having a shape including a trunk and a plurality of branches that branch off perpendicularly or obliquely from the trunk and that have grown two- or three-dimensionally, accounted for 50% by number or more of all the silver powder particles being observed.

Taking into consideration the results for the Examples and the results of tests heretofore conducted by Inventors, it was found that, by setting the aforementioned ratio D50N/D50D within a predetermined range, a dendritic silver powder at least having a D50D of 1.0-15.0 μm can offer sufficient electroconductivity even when mixed with a synthetic resin and made into an electroconductive film, and the electroconductivity of the film can be maintained even when the film prepared by mixing the dendritic silver powder and synthetic resin is stretched and the film thickness is changed.

The invention claimed is:

1. A dendritic silver powder comprising silver particles having a shape including a trunk and a plurality of branches that branch off perpendicularly or obliquely from the trunk and that have grown two- or three-dimensionally under observation of an electron microscope at a magnification of 3000 to 10000, the silver particles accounting for 50% by number or more based on all the silver particles being observed, wherein:

D50D of the silver powder is 1.0-15.0 μm, wherein D50D is defined by a volume cumulative particle diameter D50 of the silver powder, and wherein D50 is measured by a laser diffraction/scattering particle size distribution measurement apparatus with a pretreatment wherein a dispersion containing the silver powder, a dispersant and water is subjected to irradiation of 300 watts of ultrasonic waves for 3 minutes, and D50N/D50D of the silver powder is 1.0-10.0, wherein D50N is defined by a volume cumulative particle diameter D50 of the silver powder, and wherein D50 is measured by a laser diffraction/scattering particle size distribution measurement apparatus without the irradiation of ultrasonic waves, that is carried out in measuring D50D, to a dispersion containing the silver powder, a dispersant and water.

2. The dendritic silver powder according to claim 1, wherein a specific surface area measured according to a BET single-point method is 0.2-5.0 $m^2/g$.

3. The dendritic silver powder according to claim 1, wherein a crystallite diameter of the silver particles is 500 Å-3000 Å.

4. The dendritic silver powder according to claim 2, wherein a crystallite diameter of the silver particles is 500 Å-3000 Å.

* * * * *